US007730564B2

(12) United States Patent
Moore

(10) Patent No.: US 7,730,564 B2
(45) Date of Patent: Jun. 8, 2010

(54) PILLOWCASE DISPLAY FOR DOLLS AND STUFFED ANIMALS

(76) Inventor: Merideth Eastridge Moore, 20 Cambridge Way, Campbellsville, KY (US) 42718

( * ) Notice: Subject to any disclaimer, the term of this patent is extended or adjusted under 35 U.S.C. 154(b) by 2 days.

(21) Appl. No.: 12/185,661

(22) Filed: Aug. 4, 2008

(65) Prior Publication Data

US 2010/0024130 A1 Feb. 4, 2010

(51) Int. Cl.
*A47G 9/10* (2006.01)
*A63H 3/00* (2006.01)

(52) U.S. Cl. ..... 5/639; 5/640; 5/490; 446/72; D6/601

(58) Field of Classification Search ..... 5/482, 5/485, 486, 490, 491, 639, 640, 655, 907; 446/72, 73, 227; D6/601
See application file for complete search history.

(56) References Cited

U.S. PATENT DOCUMENTS

| | | | | |
|---|---|---|---|---|
| 1,533,428 | A | 4/1925 | Kittleson | |
| 1,867,422 | A * | 7/1932 | Shapiro | 446/369 |
| 3,789,546 | A * | 2/1974 | Morrison | 446/327 |
| 5,118,318 | A * | 6/1992 | Lorizio | 446/72 |
| 5,208,934 | A * | 5/1993 | Bachnick et al. | 5/482 |
| 5,778,468 | A * | 7/1998 | Saarela et al. | 5/636 |
| 5,803,331 | A | 9/1998 | Thorne et al. | |
| 5,813,584 | A | 9/1998 | Mauser | |
| 5,888,117 | A | 3/1999 | Sutton | |
| 5,975,392 | A | 11/1999 | Miller et al. | |
| 6,038,720 | A * | 3/2000 | Matthews et al. | 5/639 |
| 6,190,045 | B1 | 2/2001 | Schulman | |
| 6,233,763 | B1 * | 5/2001 | Spaan | 5/485 |
| 6,267,638 | B1 * | 7/2001 | Connolly et al. | 446/73 |
| 6,510,974 | B2 | 1/2003 | Willingham et al. | |

FOREIGN PATENT DOCUMENTS

| | | | |
|---|---|---|---|
| JP | 2002-119769 | A | 4/2002 |
| JP | 2004-129828 | A | 4/2004 |
| WO | 92-21264 | A1 | 12/1992 |
| WO | 2006-083456 | A1 | 8/2006 |

* cited by examiner

*Primary Examiner*—Michael Trettel
(74) *Attorney, Agent, or Firm*—Michael I Kroll

(57) ABSTRACT

A pillowcase display has a skirting attached to and forming the hem of a pillowcase, with a number of display apertures passing through the skirting, the skirting includes a number of fabric pieces which may be any size, shape or color, with co-aligned apertures. The apertures can incorporate an elastomeric material, for placing the display items through, so that a figure such a doll or plush toy can be displayed with the head outside the pillowcase and the body within the pillowcase.

21 Claims, 11 Drawing Sheets

PILLOWCASE DISPLAY FOR DOLLS AND STUFFED ANIMALS

BACKGROUND OF THE INVENTION

1. Field of the Invention

The present invention relates generally to displays, and, more specifically, to a method of displaying items like dolls and plush toys along the hem of a pillowcase. The pillowcase display of the present invention comprises a pillowcase having display apertures for dolls and stuffed animals with a plurality of apertures positioned near the hem of the pillowcase whereby the display articles have their body portions inside the pillowcase with the head portions extending outside the pillowcase through the apertures.

The present invention provides a pillowcase display for a pillow. The pillowcase has a length of skirting attached to the hem of the pillowcase with a plurality of pieces of fabric. The fabric pieces and pillow case skirting can be of any color, shape or pattern with co-aligned apertures passing through both so that a number of dolls and/or stuffed animals can be placed with the body portion within the skirting and the head portion extending through the piece-fabric.

2. Description of the Prior Art

There are other display cases designed for displaying articles. Typical of these is U.S. Pat. No. 1,533,428 issued to Kittleson on Apr. 14, 1925.

Another patent was issued to Thorne et al. on Sep. 8, 1998 as U.S. Pat. No. 5,803,331. Yet another U.S. Pat. No. 5,813,584 was issued to Mauser on September 1998 and still yet another was issued on Mar. 30, 1999 to Sutton as U.S. Pat. No. 5,888,117.

Another patent was issued to Miller et al. on Nov. 2, 1999 as U.S. Pat. No. 5,972,392. Yet another U.S. Pat. No. 6,190,045 was issued to Schulman on Feb. 20, 2001. Another was issued to Willingham et al. on Jan. 28, 2003 as U.S. Pat. No. 6,510,974 and still yet another was issued on Dec. 10, 1992 to Ishiwa as P.C.T. Publication No. WO9221264.

Another patent was issued to Takeda on Apr. 23, 2002 as Japanese Patent No. JP2002119769. Yet another Japanese Patent No. JP2004129828 was issued to Yamada on Apr. 30, 2004. Another was issued to Herzog on Aug. 10, 2006 as P.C.T. Publication No. WO2006/083456.

U.S. Pat. No. 1,533,428

Inventor: Caroline T. Kittleson

Issued: Apr. 14, 1925

A combined doll and hand bag comprising a body portion having bores therein, a skirt having its front portion secured to said body portion, and its rear portion free of said body; a drawstring for carrying the doll, said string being passed through said bores and through the rear portion of said skirt, and a pocket having one side secured to said body and the other side secured to the rear portion of said skirt, whereby said pocket is adapted to be closed when said drawstring is tightened.

U.S. Pat. No. 5,803,331

Inventor: Jodi L. Thorne et al.

Issued: Sep. 8, 1998

A carrier for doll-type toys is provided having a pocket like enclosure for carrying the doll-type toy in a partially displayed position. The enclosure includes a double wall section forming an envelope or bag, in which the doll-type toy is carried, and a single wall section, against which the doll-type toy is partially displayed. This single wall section extends beyond and above the double walled section. Carrying straps permit the enclosure to be carried on the back of a child, in back-pack fashion. The carrying straps are attached adjacent to the free end of the single wall section and at the side of the double wall section. A second and smaller pocket enclosure may be attached to the front face of the carrier.

U.S. Pat. No. 5,813,584

Inventor: Ann Carlisle McKay Mauser

Issued: Sep. 29, 1998

A stuffed toy carrier for attachment to a strap or the like object by use of a reusable hook and pile fastener. The carrier allows for securement of a stuffed toy as well as ease of accessibility to the toy. The carrier forms a pocket-like structure having a top opening constricted by an elastic band formed integral to the upper rim and a first and second aperture for positioning the legs of the stuffed toy.

U.S. Pat. No. 5,888,117

Inventor: Renee Sutton

Issued: Mar. 30, 1999

A decorative display apparatus comprises a transparent, liquid water filled display positionable in an inanimate object. The liquid display includes a one-piece, molded plastic base having inner and outer concentric rings extending from its front surface. A semi-spherical transparent enclosure made of hard or deformable plastic overlies a portion of the front surface, with lower edges of the enclosure being sealingly connected to the front surface between the rings. Decorative objects and water having miniature objects suspended therein fill the cavity defined by the front surface of the base and the inner walls of the enclosure. Holes for receiving connector, such as thread, are provided along the outer flange portion of the base. The liquid display is positioned in an opening provided in the inanimate object, which is preferably a stuffed animal, a beanbag, a pillow, a backpack or a key chain. When assembled, the inner surface of the inanimate object surrounding the opening engages the outer flange portion of the front surface of the base, thereby securing the display to the inanimate object. While additional connector, such as adhesive, thread, and mating swatches of hook-and-loop fastener material, may be provided, no securing assembly integral with or removable from the inanimate object is required.

U.S. Pat. No. 5,975,392

Inventor: Judith A. Miller et al.

Issued: Nov. 2, 1999

A toy backpack has a harness for securing a toy figure to the backpack, where the harness includes a pair of shoulder straps for engaging the shoulders of the toy figure, a leg strap for insertion between the legs of the toy figure, and a fastener for the shoulder straps to connect the shoulder straps with the leg strap to secure the toy figure to the backpack.

U.S. Pat. No. 6,190,045

Inventor: Dale Schulman

Issued: Feb. 20, 2001

The present invention would be a tubular bag or container constructed of transparent plastic. The bag or container would include two end mounted holes and two side mounted holes which are carved into the bag or container, allowing easy access. Elastic bands would circumferentially surround the holes and when the elastic bands would be expanded, a user could insert large items into the bag or container to store these items for a particular length of time. As an option, the present invention could be manufactured in a variety of sizes and from different materials, such as nylon or any other washable fabric.

U.S. Pat. No. 6,510,974

Inventor: Lynne Willingham et al.

Issued: Jan. 28, 2003

A backpack is provided including a substantially typical construction including a pack having a back panel, front panel and one or more side panels. The pack includes an interior storage compartment for storing objects. Furthermore, the backpack includes a pair of shoulder straps so as to enable one to wear the backpack on one's back. Located within the pack's storage compartment are first and second sets of pockets. The first set of pockets are attached to the inside surface of the pack's back panel. The first set of pockets include openings which open upwardly when the pack is in a closed condition. Meanwhile, the pack includes a second set of pockets which are attached to the inside surface of the pack's front panel. The second set of pockets include openings at the pocket's lower extremities when the pack is in a closed condition. However, when the pack is opened, the pockets rotate so that the openings of the second set of pockets are located at the pocket's upper extremities when the pack is in an open condition. Preferably, the backpack includes a flap for displaying ornamental designs or features which extends rearwardly and downwardly from the pack's front panel.

P.C.T. Publication Number WO9221264

Inventor: Takuzo Ishiwa

Issued: Dec. 10, 1992

A packaging bag or deformed bag (1) made of film of plastic such as polyethylene, comprising a bag proper (2), pattern (3) drawn thereon, opening (4), and string (8), in which the whole or a part of the pattern (3) is composed of two sheets of films made of a material composing the bag or other material of the same kind, the sheets are heat-sealed at the periphery thereof so that a hollow pattern (3) is formed, and the hollow pattern is inflated with air blown thereinto via an opening (5) having a check valve to produce a three-dimensional pattern (3). The pattern (3) of the bag (1) not only is three-dimensional and adds to feeling of mass but also exhibits toy-like effects offered by popular characters and mascot dolls, whereby the bag (1) is made more unique and prettier than before and the production cost for the bag is held almost equal to that for prevailing deformed bags.

Japanese Patent Number JP2002119769

Inventor: Masanori Takeda

Issued: Apr. 23, 2002

PROBLEM TO BE SOLVED: To provide a doll bag with an excellent safety capable of preventing an injury when a user brings a care play toy and a doll. SOLUTION: In the doll bag 1, two shoulder belts 3 are attached to a back surface and a belt 4 fixing a doll is attachably/detachably provided on a front surface.

Japanese Patent Number JP2004129828

Inventor: Hiroshi Yamada

Issued: Apr. 30, 2004

PROBLEM TO BE SOLVED: To provide a cellular phone holder, into or out of which a cellular phone can be easily put or taken, and which is portable on the user's body, attachable to a bag or a waist and is equipped with a safe and reliable slip preventing means, and a method of easily putting or taking a doll or the like into or out of a storage case, stably putting it therein, and preventing it from excessive swinging when it is hung outside.

SOLUTION: As shown in the figure, a storage case B is attached to a collapsible mounting plate A having a snap fastener (concave) 1 and two snap fasteners (convex) 2 by way of a rivet 3. A ring C provided on the mounting plate A is connected to a shoulder strap D, which is made telescopic with four cylindrical units 6 each composed of a vinyl pipe (a) and a can (b), by way of joint couplings 4 and 5. In addition, a wallet H has two snap fasteners (concave) 1 to be detachably attached to the snap fasteners (convex) 2 of the mounting plate A. A holding ring G having a partially linear portion is fixed to the body of a mascot doll F by way of a pin (e).

P.C.T. Publication Number WO2006/083456

Inventor: Shelag Herzog

Issued: Aug. 10, 2006

A purse that converts into a doll bed, having an upwardly facing basket; fabric mounted in the basket and which extends upwardly from the basket to form an upwardly facing container that may serve as either a purse or a doll bed; straps secured to the upper end of one of the fabric or the basket so that the combination purse and doll bed may be readily carried; the fabric of the purse extends upwardly sufficiently so that the fabric may form a purse or be folded outwardly to form a doll bed; and a fabric hood secured to the interior of the fabric which may lay concave when the fabric is formed into a purse or be lifted to serve as a toy sunshade for a doll when the fabric is formed into a doll bed.

While these display devices may be suitable for the purposes for which they were designed, they would not be as suitable for the purposes of the present invention, as hereinafter described.

SUMMARY OF THE PRESENT INVENTION

A primary object of the present invention is to provide a pillowcase display for doll-like articles to be displayed.

Another object of the present invention is to provide a pillowcase display comprising a pillowcase having a pillowcase skirting attached to the hem end of the pillowcase.

Yet another object of the present invention is to provide a pillowcase display wherein the pillowcase skirting can be of any length, color or pattern having a plurality of apertures passing through the pillowcase display.

Still yet another object of the present invention is to provide a pillowcase display having a plurality of fabric pieces attached to the pillowcase skirting wherein the fabric pieces are of any shape, color or pattern.

An additional object of the present invention is to provide a pillowcase display wherein the fabric pieces have an aperture therethrough that co-align with the pillowcase skirting apertures.

A further object of the present invention is to provide a pillowcase display wherein the pillowcase skirting is an integral part of the pillowcase.

A yet further object of the present invention is to provide a pillowcase display wherein the pillowcase skirting apertures and the piece-fabric apertures incorporate an elastomeric material along the rim for frictionally engaging the displayed article.

A still yet further object of the present invention is to provide a pillowcase display wherein the pillowcase skirting is removably attached to a user supplied pillow.

Another object of the present invention is to provide a pillowcase display wherein the removable pillowcase skirting attachment is taken from the group of zipper, adhesive, clip, snap and Velcro.

Yet another object of the present invention is to provide a pillowcase display wherein a user provides dolls/stuffed toys that the body portion is placed within the pillowcase skirting with the head portion inserted through the pillowcase skirting aperture therein forming a pillowcase displayed article.

Additional objects of the present invention will appear as the description proceeds.

The present invention overcomes the shortcomings of the prior art by providing a pillowcase having display apertures for dolls and stuffed animals with a plurality of apertures positioned at the hem of the pillowcase whereby the display articles have their body portion within the pillowcase with the head portions extending through the apertures to the exterior of the pillowcase. The pillowcase has a length of pillowcase skirting attached to the pillowcase opening with a plurality of pieces of fabric attached to the pillowcase skirting. The piece-fabric and pillowcase skirting can be of any color, shape or pattern with co-aligned apertures passing through both so that a number of dolls and/or stuffed animals can be placed with the pillowcase body portion within the skirting and the head portion extending through the piece-fabric.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing figures in which.

DESCRIPTION OF THE REFERENCED NUMERALS

Figure 1:
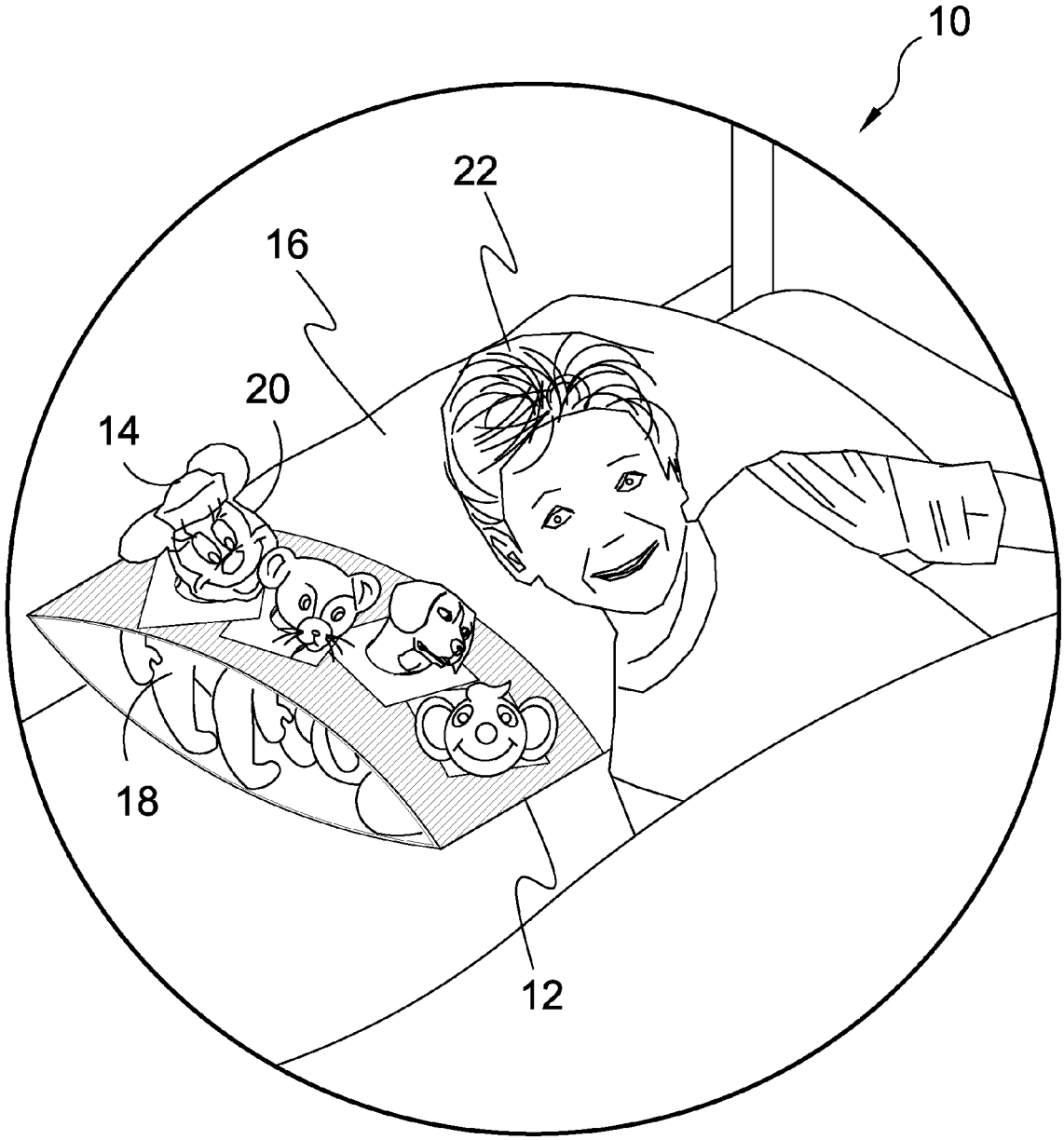
FIG. 1 is an illustrative view of the present invention in use.

Turning now descriptively to the drawings, in which similar reference characters denote similar elements throughout the several views, the figures illustrate the Pillowcase Display for Dolls and Stuffed Animals of the present invention. With regard to the reference numerals used, the following numbering is used throughout the various drawing figures.

10 Pillowcase Display for Dolls and Stuffed Animals of the present invention
12 decorative display skirt
14 display item
16 pillowcase
18 body portion of 16
20 head portion of 16
22 child
24 hem of 16
26 aperture
28 decorative overlay
30 pillow
32 interior of 16
34 stitching
36 elastomeric material
38 fastening element
40 hook and loop fastening element
42 zipper
44 adhesive
46 clips
48 buttons
50 snaps

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. Shown is the pillowcase display skirt 12 of the present invention 10 comprising apertures for display items 14 such as dolls and stuffed animals positioned at the hem of the pillowcase 16 whereby the display items 14 have their body portions 18 within the interior of the skirt 12 with the head portions 20 extending through the apertures to the exterior. Shown is a child 22 with his head on the pillowcase 16 with the display items 14 positioned in the skirt 12.

Figure 2:
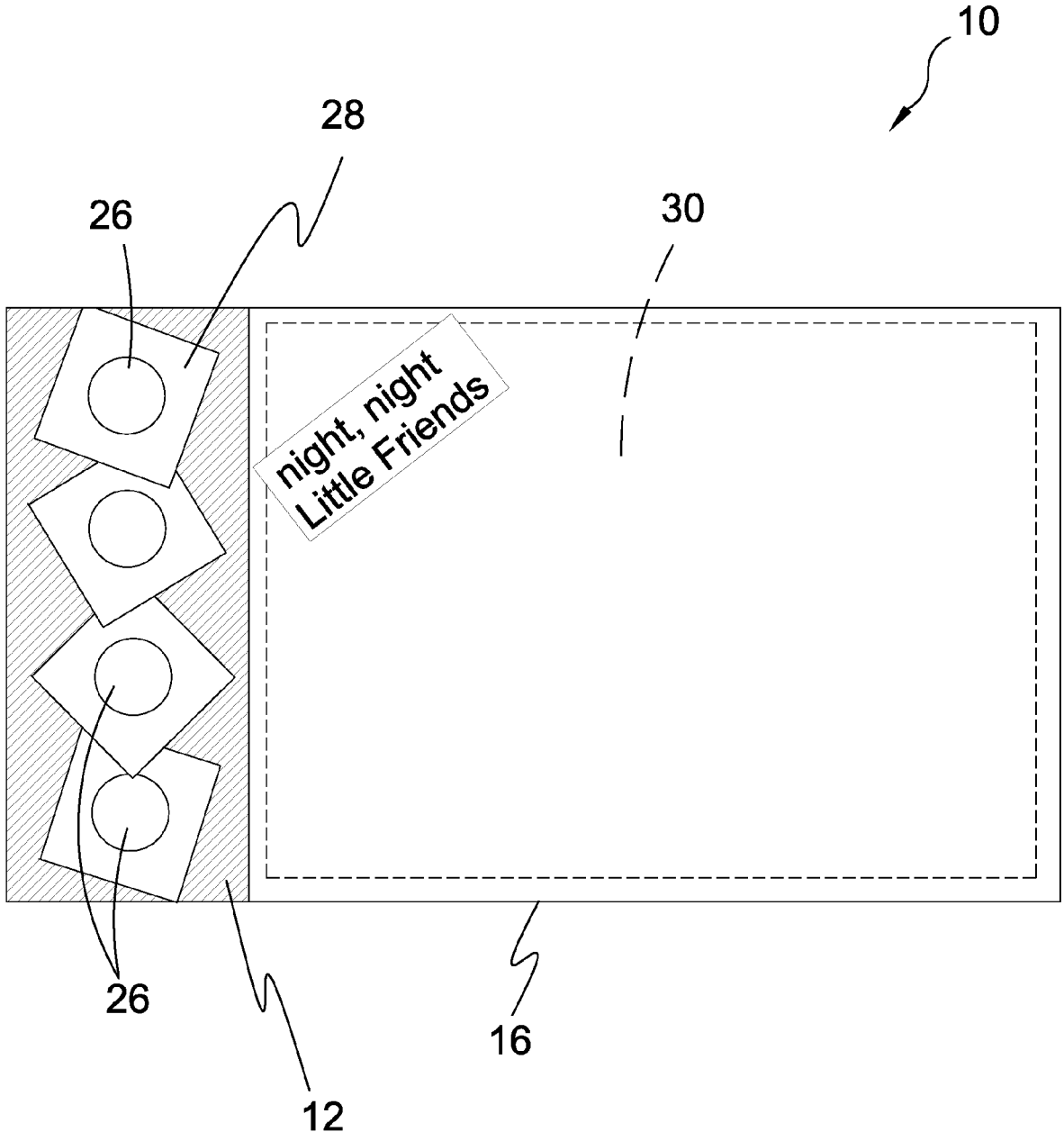
FIG. 2 is a top view of the pillowcase display of the present invention.

FIG. 2 is a top view of the present invention 10. Shown is the display skirt 12 attached to the open hem 24 of a pillowcase 16 with a plurality of apertures 26 disposed therein. Each aperture 26 has a decorative overlay 28 with co-aligned apertures. Each overlay 28 can have any of a plurality of colors or designs. A pillow 30 is disposed within the pillowcase 16.

Figure 3:
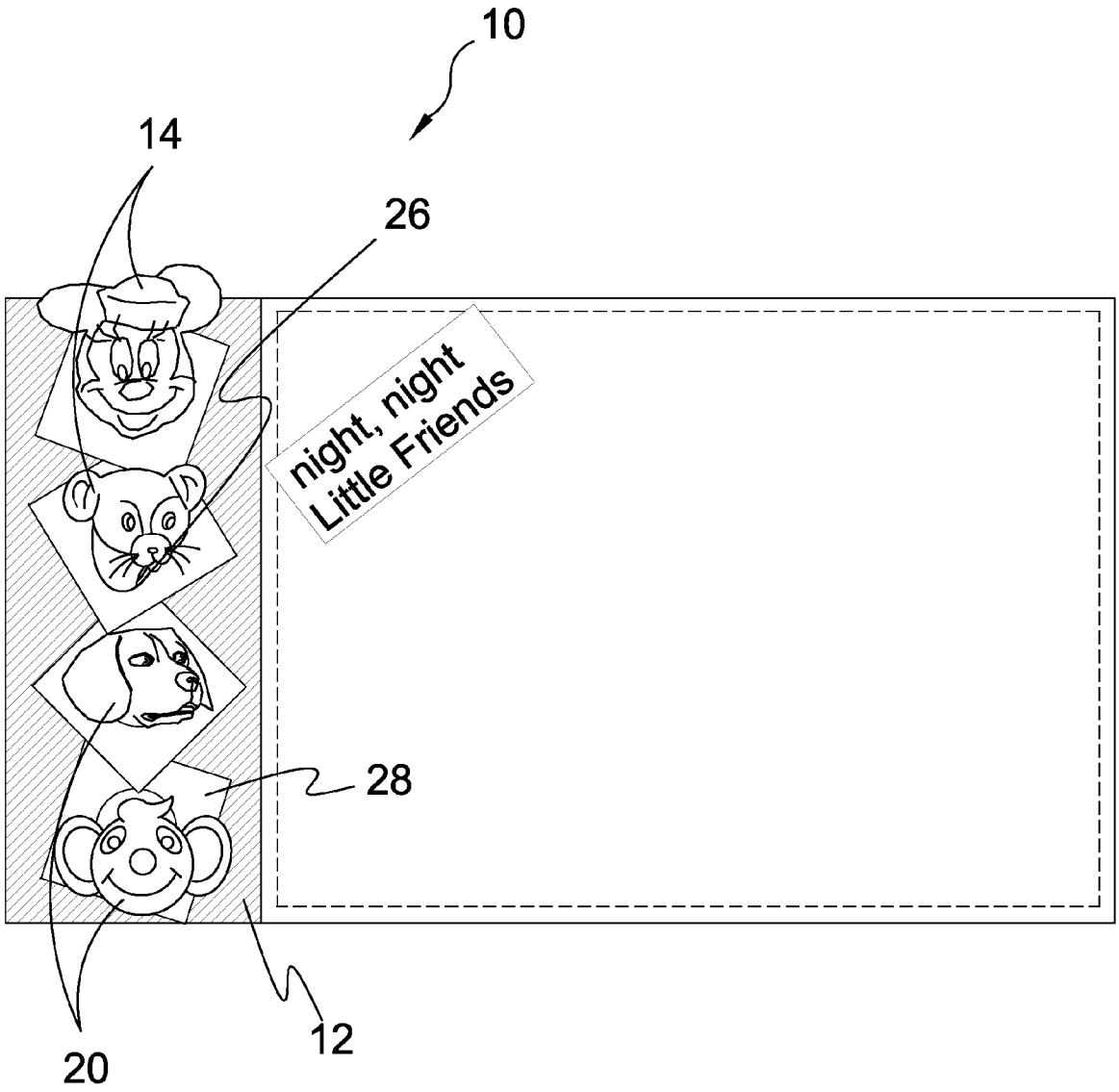
FIG. 3 is a top view of the pillowcase display of the present invention in use.

FIG. 3 is a top view of the present invention 10 in use. Shown are the heads 20 of the display items 14 extending through the apertures 26 of the skirt 12.

Figure 4:
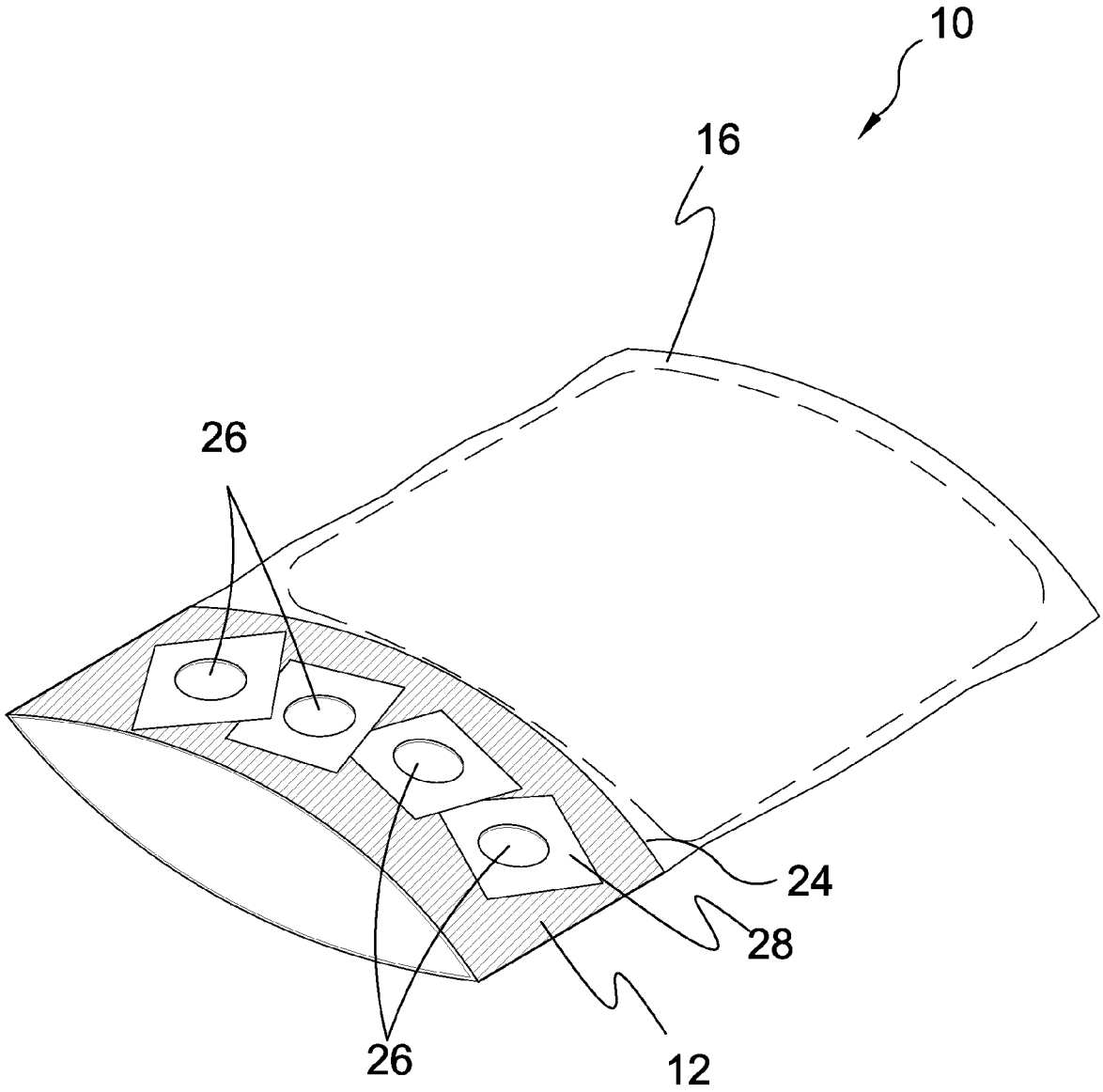
FIG. 4 is a top perspective view of the pillowcase display of the present invention.

FIG. 4 is a top perspective view of the present invention 10. Illustrated is a pillowcase 16 with a skirt 12 for displaying a plurality of display items, such as dolls and stuffed animals. The pillowcase 16 has a length of pillowcase skirting 12 attached to the hem 24 of the pillowcase opening with a plurality of pieces of fabric overlays 28 attached thereto. The fabric overlays 28 and pillowcase skirting 12 can be of any color, shape or pattern with co-aligned apertures 26 passing through both so that a number of dolls and/or stuffed animals can be placed with the body portion within the skirting 12 and the head portion extending therethrough.

Figure 5:
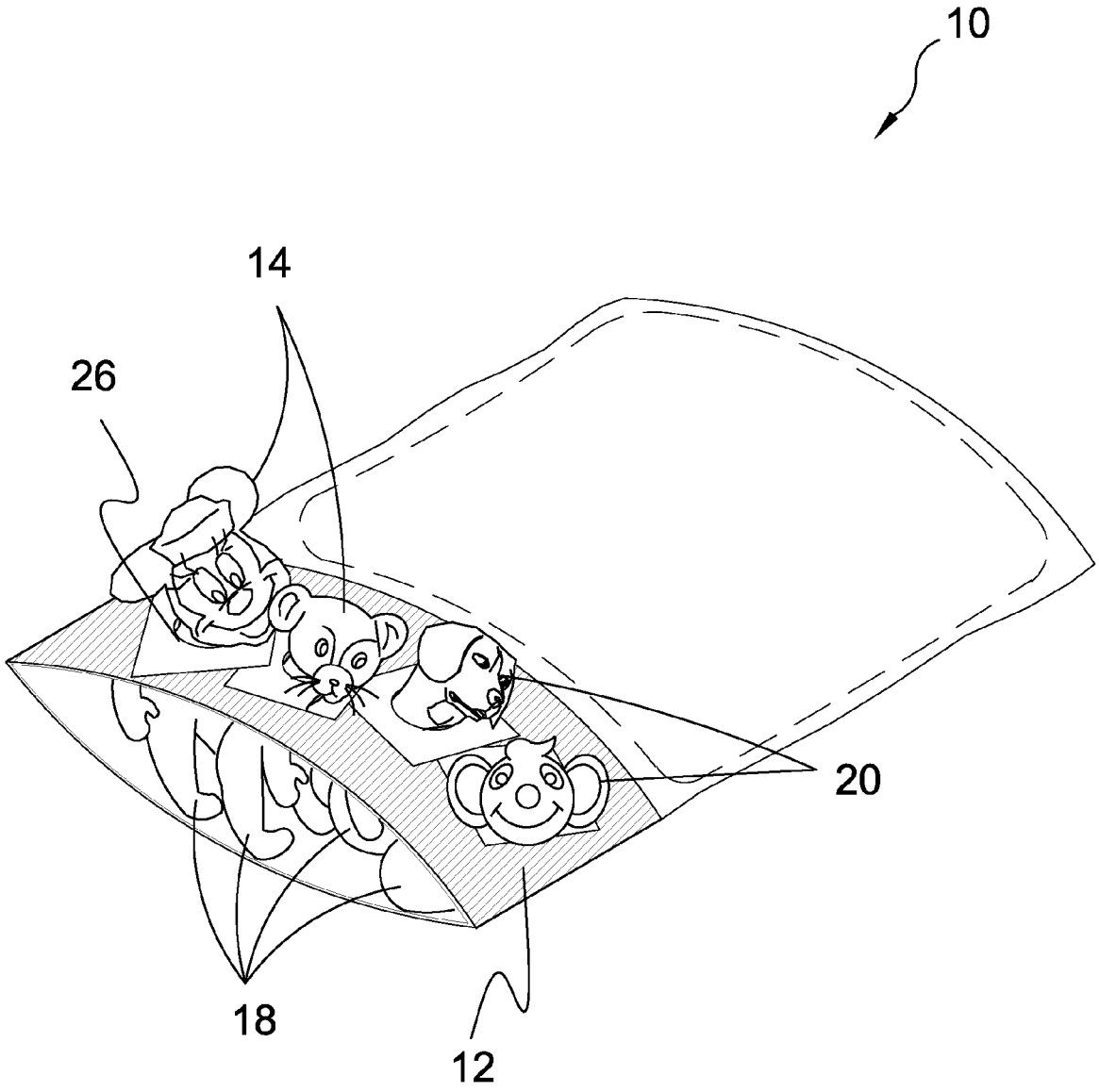
FIG. 5 is a top perspective view of the pillowcase display in use.

FIG. 5 is a top perspective view of the present invention 10 in use. Shown is the pillowcase display of the present invention 10 serving as the display article having a plurality of display items 14 that are positioned with the bodies 18 within the pillowcase skirting 12 with the head portion 20 extending through the provided apertures 26.

Figure 6:
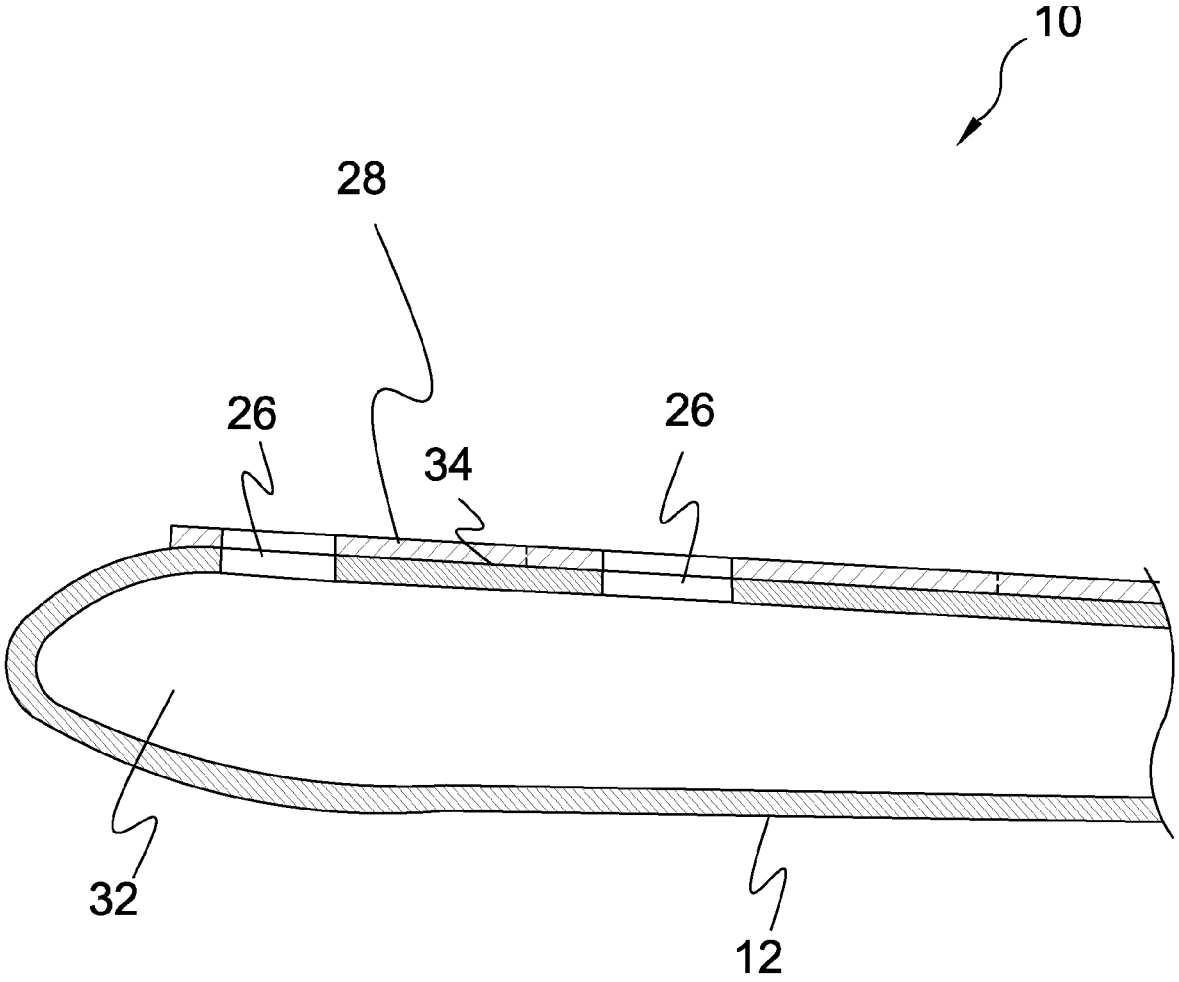
FIG. 6 is a sectional view of the pillowcase display.

FIG. 6 is a sectional view of the present invention 10. Shown is the skirting 12 with the overlays 28 stitched 34 thereto with their co-aligned apertures 26. Also shown is the access to the pillowcase interior 32.

Figure 7:
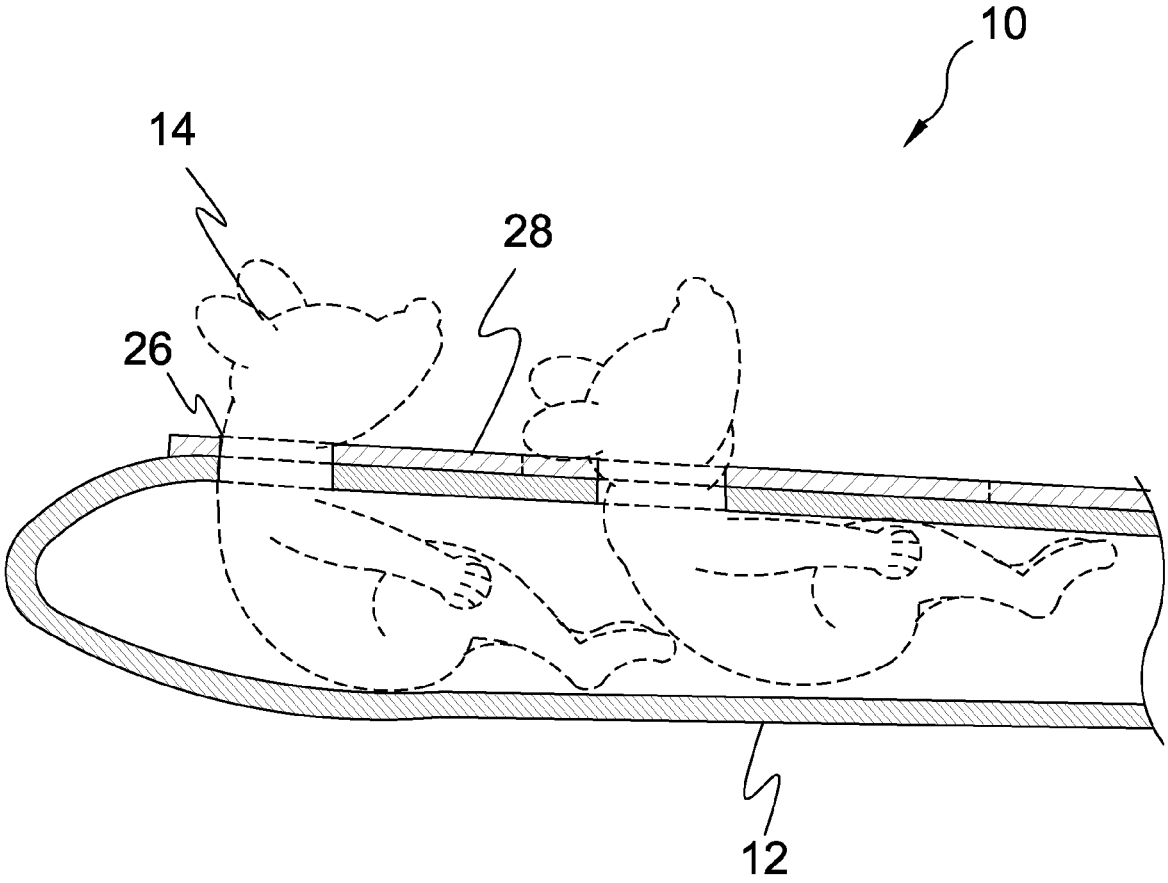
FIG. 7 is a sectional view of the pillowcase display in use.

FIG. 7 is a sectional view of the present invention 10 in use. Shown are a plurality of display items 14 inserted in their respective co-aligned apertures 26 in the skirting 12 and the decorative overlays 28.

Figure 8:
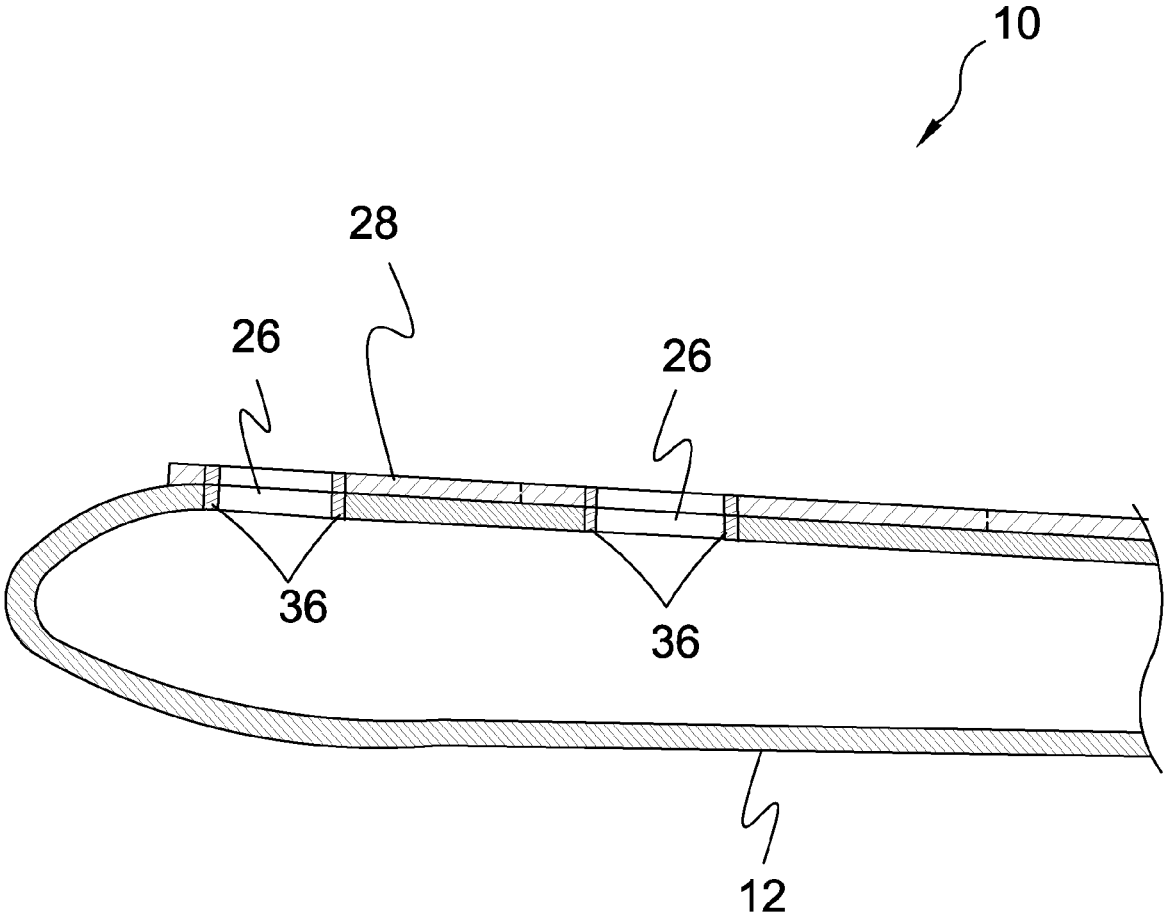
FIG. 8 is a sectional view of an additional element of the pillowcase display.

FIG. 8 is a sectional view of an additional element of the present invention 10. An elastomeric material 36 has been added to the periphery of the apertures 26 in the skirting 12 and the overlays 28 to frictionally grip the display items when in place.

Figure 9:
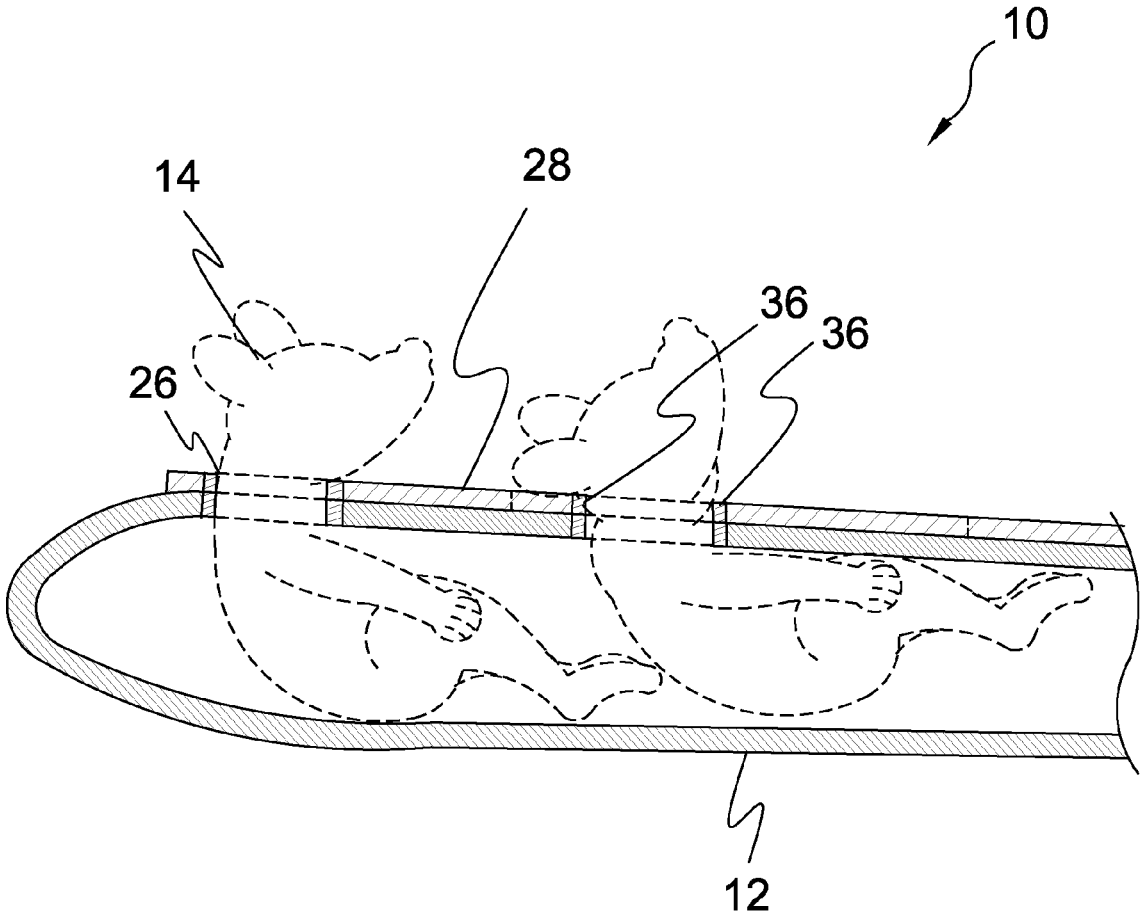
FIG. 9 is a sectional view of the pillowcase display having an additional element in use.

FIG. 9 is a sectional view of the present invention 10 having an additional element in use. Shown is a plurality of display items 14 secured within the apertures 26 of the skirting 12 and their respective overlays 28 by the elastomeric material 36.

Figure 10:
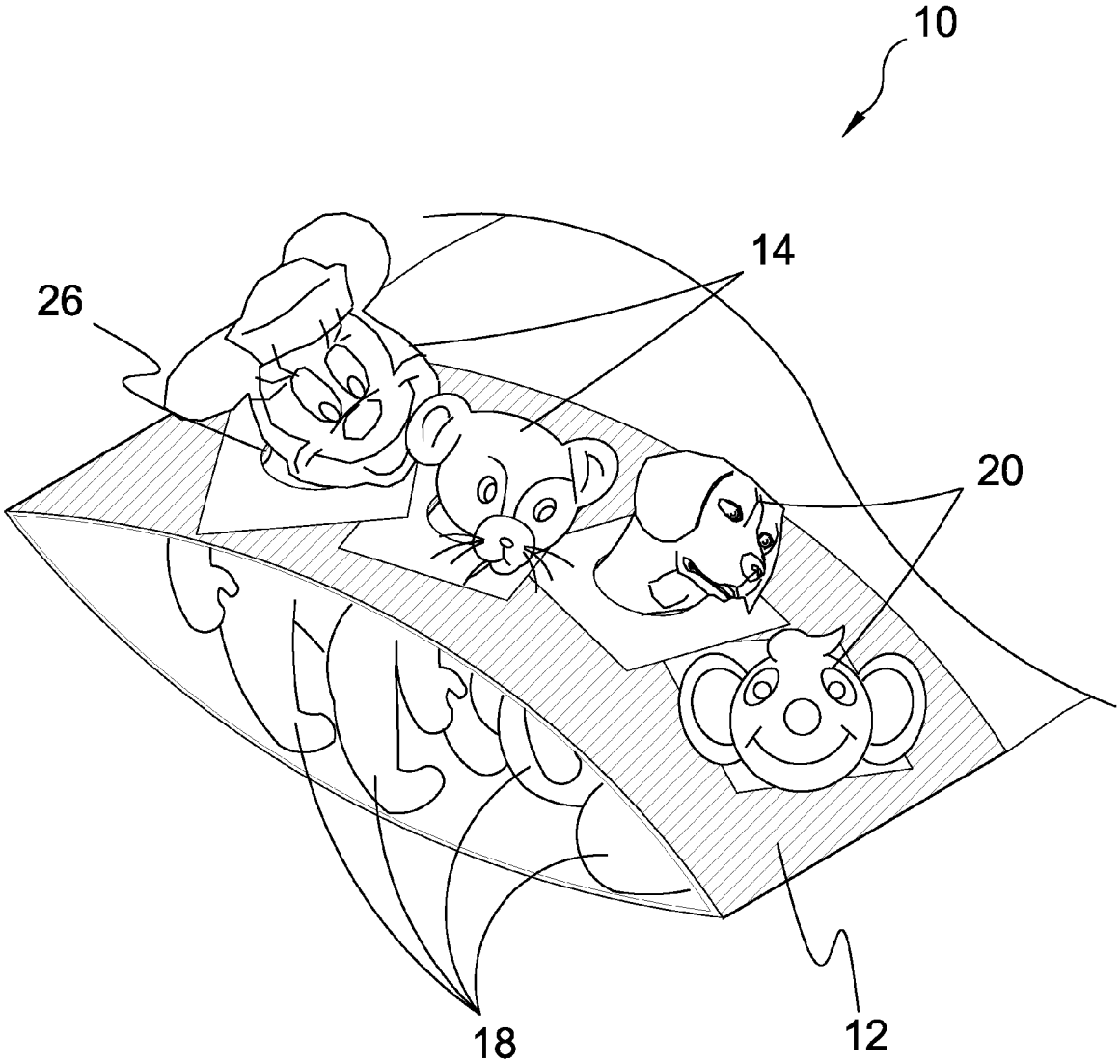
FIG. 10 is an enlarged view of the pillowcase display of the present invention in use.

FIG. 10 is an enlarged top perspective view of the present invention 10 in use. Shown is the pillowcase display of the present invention 10 serving as the display article having a plurality of display items 14 that are positioned with the bodies 18 within the pillowcase skirting 12 with the head portion 20 extending through the provided apertures 26.

Figure 11:
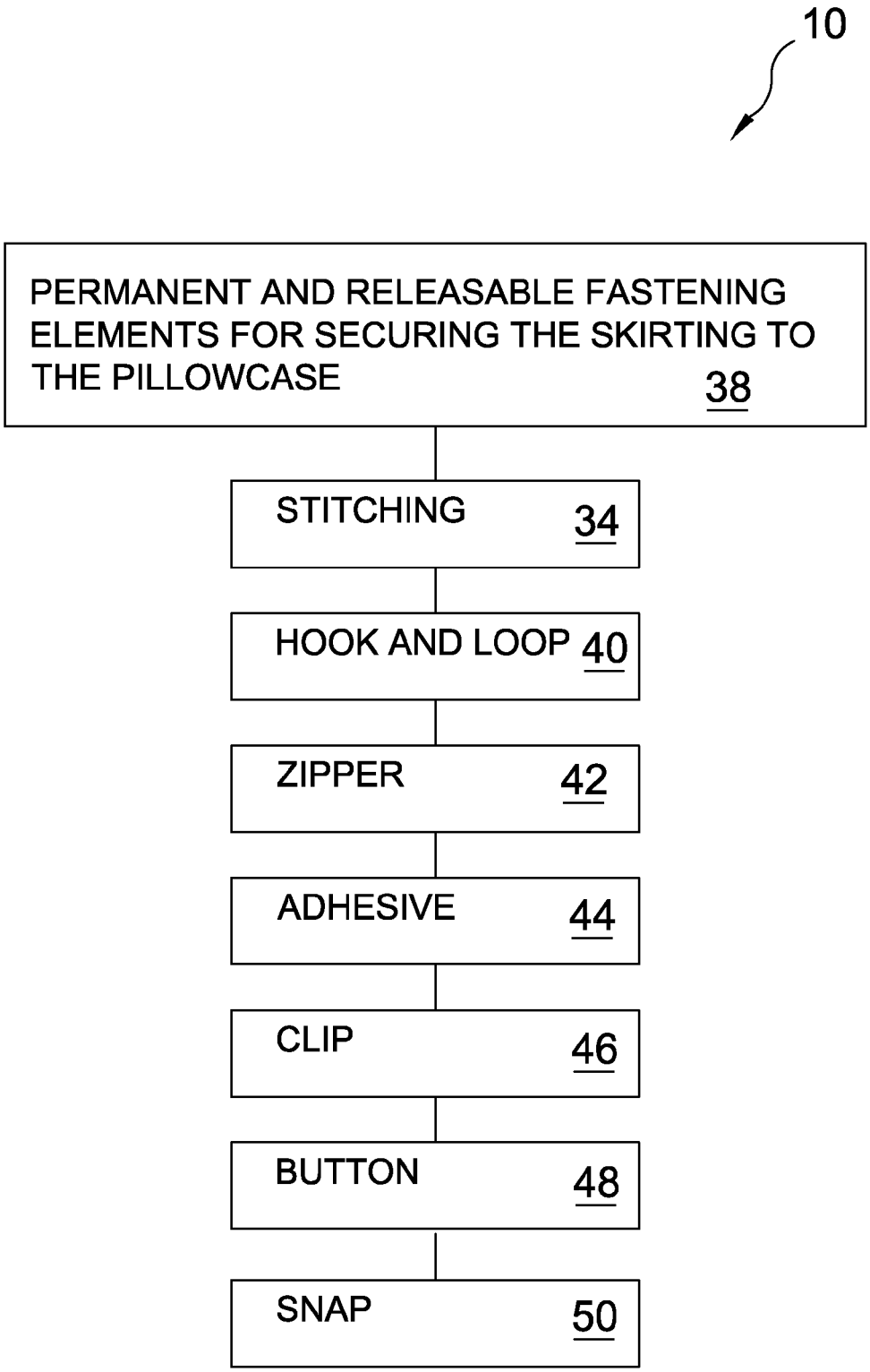
FIG. 11 is a block diagram of the fastening elements of the present invention.

FIG. 11 is a block diagram of the various fastening elements 38 of the present invention 10. The skirting can be permanently or releasably secured to the pillowcase by stitching 34, hook and loop fasteners 40, zippers 42, adhesive 44, clips 46, buttons 48 or snaps 50.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. Skirting for a pillowcase display comprising:

a) a fabric piece which forms a skirt of a pillowcase;

b) apertures through said skirt adapted to display items;

c) means for attaching said skirting to the pillowcase;

d) a plurality of fabric pieces overlap with co-aligned apertures; and e) means for removably attaching said skirting to the pillowcase.

2. Skirting for a pillowcase display according to claim 1, wherein said apertures incorporate an elastomeric material.

3. Skirting for a pillowcase display according to claim 1, wherein said means for removably attaching said skirting to the pillowcase is selected from the group of zipper, adhesive, clip, button, snap and hook-and-loop type fasteners.

4. Skirting for a pillowcase display according to claim 1, further comprising means for permanently attaching said skirting to the pillowcase.

5. Skirting for a pillowcase display according to claim 1, wherein said skirting is attached to the pillowcase such that said skirting overlaps completely a hem of the pillowcase.

6. Skirting for a pillowcase display according to claim 2, wherein said skirting is attached to the pillowcase such that said skirting extends past and forms a hem of the pillowcase.

7. A pillowcase display comprising:

a) a pillowcase;

b) a skirting attached to a hem of said pillowcase; and c) a plurality of apertures through said skirting adapted to display d) said skirting is available in a plurality of colors and decorative designs;

e) wherein said apertures incorporate an elastomeric material; and f) means for removably attaching said skirting to said pillowcase.

8. A pillowcase display according to claim 7, wherein a plurality of fabric pieces overlap with co-aligned apertures.

9. A pillowcase display according to claim 7, wherein said means for removably attaching said skirting to said pillowcase is selected from the group of zipper, adhesive, clip, snap and hook-and-loop type fasteners.

10. A pillowcase display according to claim 7, further comprising means for permanently attaching said skirting to said pillowcase.

11. A pillowcase display according to claim 7, wherein said skirting is attached to said pillowcase such that said skirting overlaps completely said hem of said pillowcase.

12. A pillowcase display according to claim 7, wherein said skirting is attached to said pillowcase such that said skirting extends past and forms the hem of said pillowcase.

13. A pillowcase display according to claim 7, further comprising a pillow inside said pillowcase.

14. A pillowcase display according to claim 13, further comprising a plurality of display items displayed in said apertures.

15. A pillowcase display according to claim 14, wherein said display items comprise figures having a head portion and a body portion, said display items displayed with said body portions inside said pillowcase with said head portions outside said pillowcase through said apertures.

16. A method of displaying items comprising the steps:

a) providing a skirting for a pillowcase, said skirting formed from a fabric piece which forms a hem of a pillowcase, a plurality of apertures through said fabric piece, and means for attaching said skirting to a pillowcase;

b) attaching said skirting to a hem of a pillowcase; and c) displaying items in said apertures through said skirting;

d) a plurality of fabric pieces on said skirting form overlays having co-aligned apertures with said apertures of said skirt;

e) wherein said apertures incorporate an elastomeric material; and f) wherein said skirting is removably attached to said pillowcase.

17. A method of displaying items according to claim 16, wherein said skirting is removably attached to said pillowcase by means selected from the group of zipper, adhesive, clip, snap and hook-and-loop type fasteners.

18. A method of displaying items according to claim 16, wherein said skirting is permanently attached to said pillowcase.

19. A method of displaying items according to claim 16, wherein said skirting is attached to a pillowcase with said skirting overlapping completely said hem of said pillowcase.

20. A method of displaying items according to claim 16, wherein said skirting is attached to a pillowcase with said skirting extending past and forming the hem of said pillowcase.

21. A method of displaying items according to claim 16, wherein said display items comprise figures having a head portion and a body portion and said display items are displayed with said body portions inside said pillowcase with said head portions outside said pillowcase through said apertures.

* * * * *